United States Patent [19]

Van der Linde et al.

[11] Patent Number: 4,623,958

[45] Date of Patent: Nov. 18, 1986

[54] REPLACEABLE AUTOMOBILE HEADLIGHT LAMP UNIT

[75] Inventors: John R. Van der Linde, Deering; James P. Szep, Peterborough; David Dayton, Bow, all of N.H.

[73] Assignee: GTE Products Corporation, Stamford, Conn.

[21] Appl. No.: 691,803

[22] Filed: Jan. 15, 1985

[51] Int. Cl.[4] ..... F21V 19/00

[52] U.S. Cl. ..... 362/267; 313/113; 313/318; 362/307; 362/375

[58] Field of Search ..... 362/211, 267, 296, 300, 362/310, 375, 226, 307; 313/113, 115, 316, 318, 579; 315/82

[56] References Cited

U.S. PATENT DOCUMENTS

| | | | |
|---|---|---|---|
| 413,708 | 10/1889 | Goad | 362/158 |
| 1,713,335 | 5/1929 | Green | 362/267 |
| 2,423,664 | 7/1947 | Ryder | 362/307 |
| 2,750,491 | 6/1956 | Anderson | 362/267 |
| 3,157,449 | 11/1964 | Hennessey | 339/66 R |
| 3,593,017 | 7/1971 | Cibie | 362/267 |
| 3,688,103 | 8/1972 | Daumuller | 362/267 |
| 3,829,729 | 8/1974 | Westlund et al. | 313/174 |
| 3,885,149 | 4/1973 | Wolfe et al. | 313/318 |
| 3,917,939 | 11/1975 | Schmidt et al. | 313/113 |
| 3,960,278 | 6/1976 | Vause | 313/318 |
| 3,987,326 | 10/1976 | Lindae | 313/113 |
| 4,019,045 | 4/1977 | Bassett | 339/127 R |
| 4,287,448 | 9/1981 | Bradley | 313/113 |
| 4,336,578 | 6/1982 | Bradley et al. | 362/267 |
| 4,342,142 | 8/1982 | Nieda et al. | 29/25.13 |
| 4,344,119 | 8/1982 | Bergot | 362/267 |
| 4,412,273 | 10/1983 | Helbig et al. | 362/211 |
| 4,470,104 | 9/1984 | Cox | 362/211 |
| 4,473,770 | 9/1984 | Baba et al. | 362/267 |
| 4,528,619 | 7/1985 | Dolan et al. | 362/267 |

FOREIGN PATENT DOCUMENTS

| | | |
|---|---|---|
| 605054 | 9/1960 | Canada . |
| 2449626 | 4/1976 | Fed. Rep. of Germany . |
| 2732404 | 1/1978 | Fed. Rep. of Germany . |
| 106636 | 2/1943 | Sweden . |

*Primary Examiner*—William A. Cuchlinski, Jr.
*Attorney, Agent, or Firm*—Lawrence R. Fraley

[57] ABSTRACT

A lamp unit (10) for being removably positioned within the rear opening (11) of an automobile headlight reflector (13). The unit (10) includes a plastic holder (19), an electric (e.g., tungsten halogen) lamp (30) having a filament structure (42) contained within the envelope (33) thereof, a clamp member (46) secured to the lamp's press-sealed end portion (47), and an insert member (48) located within a cavity (21) of the holder (19). The clamp member (46) includes a plurality of flange segments (55) which are located within corresponding slot portions (56) of an aperture (57) centrally disposed within the insert member (48). The clamp member (46) is secured to the insert member (48) by the use of solder once precisioned alignment of the envelope has occurred.

16 Claims, 2 Drawing Figures

REPLACEABLE AUTOMOBILE HEADLIGHT LAMP UNIT

TECHNICAL FIELD

The invention relates to automobile headlights and more particularly to those wherein a replaceable lamp unit assembly is utilized.

BACKGROUND

Automobile headlights wherein a replaceable lamp unit is employed are well known in the art. Examples are illustrated in the below-identified patents:

U.S. Pat. No. 2,423,664, E. RYDER
U.S. Pat. No. 2,750,491, H. J. ANDERSON
U.S. Pat. No. 3,593,017, P. CIBIE
U.S. Pat. No. 3,688,103, H. DAUMULLER
U.S. Pat. No. 3,917,939, H. J. SCHMIDT ET AL
U.S. Pat. No. 3,987,326, G. LINDAE
U.S. Pat. No. 4,342,142, Y. NEIDA ET AL
U.S. Pat. No. 4,344,119, T. BERGOT
U.S. Pat. No. 4,412,273, P. HELBIG ET AL

As stated, the instant invention is related to lamps of the variety described above. In particular, the invention defines a replaceable lamp unit which provides both a hermetic seal for the unit within the headlight's reflector and, equally important, assures that the electric lamp utilized therewith will be maintained in strict alignment as is necessary in automotive headlights. By the term hermetic seal is meant a seal which prevents the passage of moisture, dust and other elements which can adversely affect the operation of the headlight. By way of example, excessive moisture entering the headlight can adversely affect the reflective coating typically utilized on the concave reflector of the headlight, and thus significantly reduce light output.

In addition to providing a hermetic seal, the replaceable lamp unit defined herein assures that alignment of the electric lamp employed therewith will be maintained. That is, alignment of the glass envelope of the lamp relative to the unit's holder is provided such that the filament structure within the envelope (either a singular coiled filament or two, spaced coiled filaments) will be accurately aligned relative to the optical axis of the reflector when the lamp unit is oriented within the reflector's rear opening. Such alignment is deemed critical to assure optimum headlight output in the direction(s) desired.

As also described herein, a preferred light source which constitutes an important part of the replaceable lamp unit defined herein is an electric lamp of the tungsten halogen variety. One example is shown in U.S. Pat. No. 3,829,719 (Westlund, Jr. et al), said patent assigned to the same assignee as the instant invention. In tungsten halogen lamps, the tungsten which constitutes the filament material is normally evaporated from the filament during lamp operation and combines with the halogen to form a gaseous halide, the halide preventing the tungsten from depositing on the internal wall of the lamp's glass envelope. Upon returning to the filament structure, the halide decomposes, resulting in the deposition of tungsten back onto the filament structure and the release of additional halogen gas to assure continuation of the cycle. The halogen cycle is well known in the art and lamps employing it have been used for some time. In the case of the two beam (dual filament) lamp, a typical tungsten halogen lamp provides about 65 watts when operated at high beam and about 35 watts at low beam. As stated, it is critical that the filament structure of the lamp within an automobile headlight be aligned relative to the reflector to provide optimum output of the finished headlight. As will be described below, such alignment constitutes an important feature of the replaceable lamp unit defined herein.

DISCLOSURE OF THE INVENTION

It is an object of the instant invention to enhance the automobile headlight art and, more particularly, to enhance that portion of the art wherein replaceable units that employ electric lamps are utilized.

It is another object of the invention to provide a replaceable lamp unit for use within an automobile headlight which provides a hermetic seal for the electric lamp positioned therein and also maintains the lamp in a fixed, precisioned relationship relative to the holder thereof such that the lamp is precisely oriented relative to the headlight's reflector when the unit is located therein.

It is another object of the invention to provide such a replaceable lamp unit which can be inexpensively produced in a manner readily adapted to mass production.

In accordance with one aspect of the invention, there is defined an improved lamp unit capable of being removably positioned within the rear opening of a reflector which constitutes part of an automobile headlight. The lamp unit is designed for being electrically connected to an external connector which forms part of the electrical circuitry of the automobile. The lamp unit includes an electrically insulative holder defining a cavity therein and an electric lamp positioned within the holder and which includes an envelope having a filament structure therein for being oriented within the reflector when the holder is located within the reflector's rear opening. The lamp unit also includes at least two electrically conductive lead-in wires projecting from the envelope. The improvement comprises a clamp member which is secured about the envelope at a precise location relative to the filament structure and an insert member having an aperture therein and located at a fixed depth within the holder's cavity. The clamp member is oriented at an established depth within the insert's aperture and secured (e.g., welded) to the insert such that the filament structure will be precisely oriented relative to said reflector.

In accordance with another aspect of the invention, there is defined an improved automobile headlight which includes a concave reflector (glass or plastic) including a rear opening therein, a front lens for directing light emitted from the electric lamp of the headlight and reflected by the reflector, and a lamp unit adapted for being removably positioned within the concave reflector's rear opening. The lamp unit includes an insulative holder for being positioned within the rear opening and defines a cavity therein. The headlight further includes an electric lamp positioned within the holder and including an envelope and at least two electrically conductive lead-in wires projecting from the envelope.

The improvement comprises a clamp member which is secured about the envelope at a precise location relative to the filament structure and an insert member having an aperture therein and located at a fixed depth within the holder's cavity. The clamp member is oriented at an established depth within the insert's aperture and secured (e.g., welded) to the insert such that the filament structure will be precisely oriented relative to the reflector.

BEST MODE FOR CARRYING OUT THE INVENTION

For a better understanding of the present invention, together with other and further objects, advantages and capabilities thereof, reference is made to the following disclosure and appended claims in connection with the above-described drawing.

Figure 1:
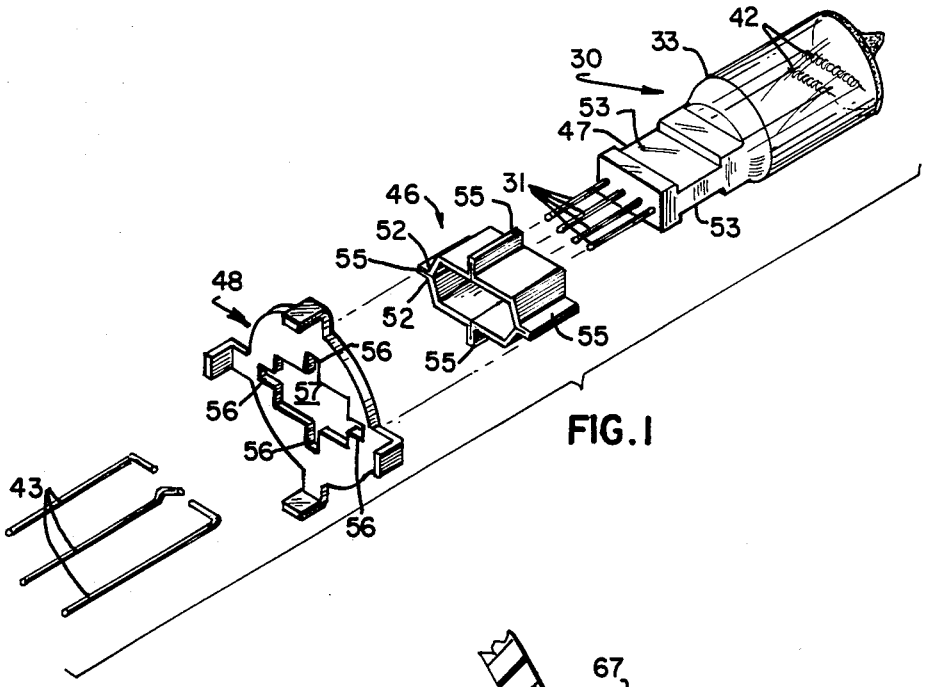
FIG. 1 represents an exploded perspective view of the electric lamp, clamp member, insert member, and support wires of a lamp unit in accordance with a preferred embodiment of the invention.

With particular attention to FIG. 1, there is illustrated in a perspective view several components which form part of a lamp unit 10 (FIG. 2) capable of being removably positioned within the rear opening 11 of a reflector 13 which forms part of an automobile headlight. Lamp unit 10 is further designed for being electrically connected to an external connector (not shown) which comprises part of the electrical circuitry of the automobile using the headlight. Specifically, this external connector is designed for being inserted within the rear portion 15 of unit 10 after unit 10 has been positioned within the reflector's opening. Such a connector typically includes a plurality of electrical wires which also form part of the automobile's circuit. These wires are thus either directly or indirectly connected to the power source (e.g., 6- or 12-volt battery) typically found in most automobiles.

Unit 10 includes an electrically insulative holder 19 which defines therein a first cavity 21 and a second cavity 23, said cavities separated by a common wall member 25. Holder 19 is comprised of a heat and impact resistant plastic (e.g., polyphenylene sulfide) and is thus readily suited for use within the relatively harsh environments typically found about automobile headlights.

Figure 2:
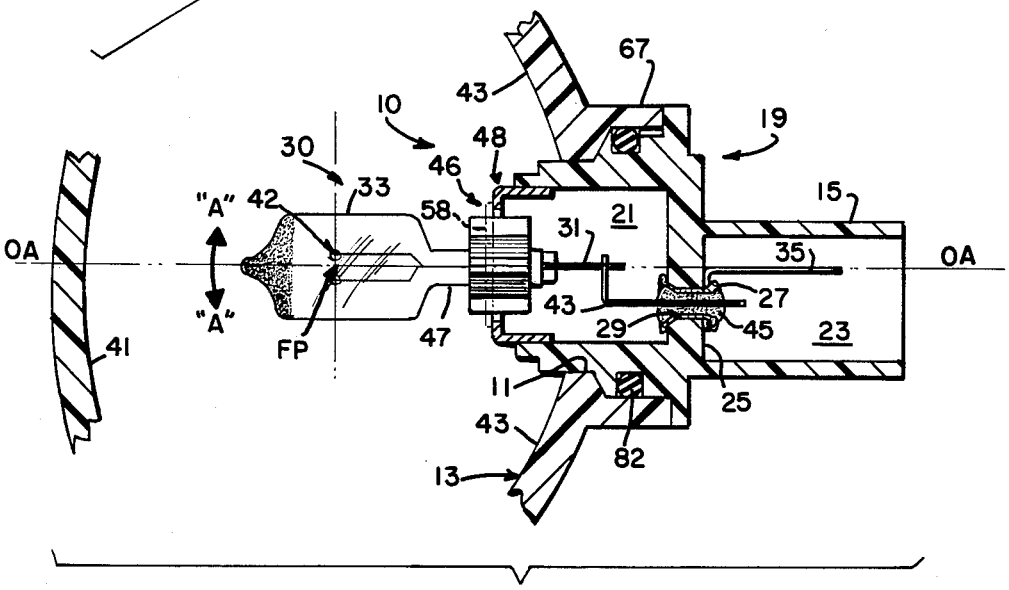
FIG. 2 is a side elevational view, in section, of the lamp unit of the invention and further illustrating the reflector and lens members of a preferred embodiment of an automobile headlight of the invention.

Unit 10 preferably further includes at least two (only one being shown) electrically conductive members 27 which are each fixedly secured within a respective one of a similar number of apertures 29 (one shown in FIG. 2) located within wall member 25. It is understood that a minimum of two apertures and corresponding electrically conductive members 27 are to be utilized in the instant invention. In the embodiment depicted herein, three members 27 (and apertures 29) are utilized because holder 19 accommodates a dual filament, tungsten halogen lamp 30. Typically, tungsten halogen lamps which include a dual coil filament structure 42 therein (such as shown in FIGS. 1 and 2) in turn include at least four lead-in wires 31 (only one being shown in FIG. 2) which project externally from the glass envelope 33 of the lamp. In the case of a single coil tungsten filament lamp, only two lead-in wires are typically utilized. It is thus understood with regard to the invention, that holder 19 is adapted for accommodating both single and double coil filament tungsten halogen lamps.

Each of the electrically conductive members 27 is preferably in the form of a conical shaped metal eyelet. A preferred material for each eyelet is tin-plated brass. Other suitable metals include aluminum, copper, steel, and nickel-iron alloy.

Electrically connected to each eyelet is a metallic lug member 35 which includes a base segment positioned firmly against wall 25 and an upstanding leg segment which extends within second cavity 23. Accordingly, each of the lug members 35 (understandably, a total of three are used in the embodiment shown in the drawing) is designed for being inserted within a corresponding opening of the aforementioned external connector to provide electrical connection therewith when the connector is inserted within cavity 23.

As stated, holder 19 is adapted for accommodating an electric lamp 30 which is preferably of the tungsten halogen variety. When in final position within opening 11 of reflector 13, the envelope 33 of lamp 30 extends within the reflector and is substantially surrounded by the reflecting surfaces 43 thereof in such a manner so as to provide optimum light output from the headlight. The headlight further includes the forward lens member 41 secured to reflector 13 and designed for directing light in a predetermined pattern from the assembled unit. Understandably, alignment of envelope 33 and particularly the filament structure 42 contained therein relative to the internal reflective surfaces 43 of reflector 13 such that filament structure 42 is precisely oriented (i.e., centered on) relative to the reflector's optical axis OA-OA and, equally important, the reflector's focal point FP, is deemed critical to assure optimum light output. Accordingly, it is essential that lamp 30 be initially precisely oriented relative to holder 19 in a fixed relationship therewith such that when the holder is finally positioned within opening 11 this critical alignment is attained. Such precisioned alignment constitutes an important feature of the instant invention, in addition to the provision of the aforementioned hermetic seal.

In FIG. 2, the lead-in wires 31 are shown projecting from envelope 33 into the first cavity 21 of holder 19. Positively secured (e.g., welded) to these wires in a predetermined manner are a plurality of rigid support wires 43, each being of L-shaped configuration and extending within (passing through) a corresponding one of the metallic eyelets 27. Each of these support wires is preferably of 0.080 inch diameter nickel-plated steel, although it is of course understood that other metals could be utilized. Attachment of each support wire 43 to a respective one of the conductive eyelets is achieved by soldering such that a quantity of solder 45 flow within the hollow eyelet and effectively surrounds the support wire centrally disposed therein. This combined connecting and sealing operation is accomplished simultaneously with the securement of the invention's clamp and insert members (see below). One example of a suitable solder for use in the invention is a 30/70 tin-lead composition. Other suitable compositions include a 60/40 tin-lead composition, and a 20/80 tin-lead composition. The solder, in addition to providing a sound electrical connection between the eyelet and support wire, also assures the defined hermeticity at this portion of the connection by virtue of its complete filling of the illustrated end portion of the eyelet. It also serves to rigidly maintain the support wire in a fixed position relative to holder 19 such that the corresponding lamp 30 will be maintained in the substantially fixed position shown. Positive positioning of the lamp is thus assured. It is underestood that for purposes of the invention support wires 43 constitute extensions of the lead-in wires 31 to which they are attached. In effect, these members thus form part of the lead-in wire assembly. Accordingly, it is within the scope of this invention to provide lead-in wires 31 of greater length, subject these to various bending operations (to form the configurations depicted in FIG. 2), and insert the ends thereof within respective eyelets 27, thus eliminating the need for support wires 43 as defined herein. In such an arrangement, these lead-in wires would assure the necessary rigid support function required in the invention.

It should also be noted that only three support wires 43 are utilized to accommodate a total of four lead-in wires 31. This is so because one of the support wires is welded (and thus electrically joined) to two lead-in wires to serve as a common lead in the overall circuit.

To provide effective connection between the respective lug members 35 and corresponding conductive eyelets 27, a mechanical operation is utilized. Specifically, a projecting end segment of each of the metallic eyelets is crimped over the leg portion of the respective lug member which rests against wall 25. Because the eyelet includes a flange portion at the opposing end thereof (against an opposing surface of wall 25), this crimping operation in effect draws the eyelet positively within the corresponding conical-shaped aperture 29. The result, therefore, is that a seal is provided between each eyelet and corresponding aperture. The defined crimping operation, as stated, functions to provide the essential electrical connection between lug and eyelet components.

In accordance with the teachings of the instant invention, lamp unit 10 further includes a new and unique means for providing precisioned alignment of the lamp's envelope (and contained filament structure) within the holder member. More specifically, the invention provides a means for precisely orienting the lamp's envelope relative to the locating surfaces of the holder which align with and engage the reflector when the holder is in final position within the reflector. This orientation prior to final securement of the lamp, including securement of the aforementioned lug and eyelet components, not only assures such precise alignment but, as explained below, is readily adaptable to mass production techniques.

To accomplish this, unit 10 includes a clamp member 46 which is secured about the press-sealed end portion 47 of envelope 33 at a precise location relative to the contained filament structure 42. In addition, unit 10 further includes an insert member 48 which is designed for occupying a predetermined, fixed depth within cavity 21 of holder 19. Both insert member 48 and cavity 21 are of substantially cylindrical shape to facilitate such insertion. In addition, the clamp and insert members are both preferably comprised of steel (i.e., stainless steel), having a thickness of only about 0.018 inch. Clamp member 46 is formed from a singular steel band which, after a series of bending operations (see below) is wrapped about the relatively flat end portion 47 such that the two end tabs 52 thereof become aligned and contact each other. A weld is then performed to connect both tabs. Precise alignment of clamp member 46 is achieved by the provision of two grooves 53, each within a respective opposing side of sealed end portion 47. Understandably, grooves 53 are precisely located at the time of pressing end portion 47. As is known in the art press-sealing of a tungsten-halogen lamp envelope typically occurs only after the lamp's filament structure has been inserted to a prescribed depth within the glass tubing which eventually forms the lamp's envelope. It is thus seen that clamp member 46 is accurately located relative to the filament structure 42 by subsequently locating at least a portion thereof within the opposed grooves. It is within the scope of the invention to provide a singular groove 53 within only one side of pressed end portion 47 and locating only one side of clamp member 46 therein. Two grooves, as depicted, are preferred, however.

During formation of clamp member 46, the member is subjected to a series of bending operations wherein a plurality of spacedly positioned, upstanding flange segments 55 are formed. As shown in FIG. 1, four flanges are formed, each within one of the four sides of member 46. One flange, as illustrated, results from the aforementioned welding of the two tabs 52 which constitute the end portions of the band from which member 46 is formed.

With clamp member 46 in place, the next step in assembling unit 10 involves inserting and fixedly securing insert member 48 within cavity 21. When achieved, preferably in a vertical orientation (lamp 30 located upright), the lamp and clamp member assembly is lowered until flange segments 55 align with and enter corresponding spaced-apart slot portions 56 which form part of a substantially rectangularly-shaped aperture 57 substantially centrally disposed within insert member 48. As shown, the main open portion of aperture 57 is designed to accommodate the corresponding open body portion (also substantially rectangular in shape when viewed from the end) of the clamp member. That is, the main, rectangular shaped portion of aperture 57 is of substantially the same, though slightly larger, shape as member 46. Similarly, slot portions 56 are each similarly shaped, though also somewhat larger, than the corresponding flange segments 55 they are designed to accommodate. Lamp 30 and the secured clamp member 46 are lowered until member 46 occupies a precise depth within aperture 57. This is considered a first direction of orientation. Lamp 30 and clamp member 46 are then moved in a side-to-side direction ("A" in FIG. 2) until the filament structure is substantially centered. At all times, the flange segments 55 (and main body portion) of clamp member 46 remain within insert member 48. When proper orientation is achieved (i.e., as determined by camera inspection), a solder preform 58 (shown in phantom in FIG. 2) is located atop the insert member. Heat is then applied so as to cause the preform to melt and flow into slot portions 57 and the rectangular, main open portion of aperture 57 whereupon any voids are completely filled, thus interconnecting the various parts of clamp member 46 and the positioned insert member 48. Insert member 48, being metallic, was securedly positioned within the plastic holder 19 using RF induction heating. That is, member 48 was previously heated to the point that softening of the inner walls of the holder occurred with said material thereafter permanently adhering to the insert. RF induction heating is also used at this stage to cause the aforedefined melting of preform 58 and subsequent interconnection (and securement) between the invention's clamp and insert members. As stated above, it is also preferred to form the aforementioned solder connection (and securement) between the eyelet and lug members of the invention simultaneously with this operation, thereby expediting assembly of unit 10. Accordingly, a solder similar to solder 45 is used at this point.

Filament structure 42 has thus been precisely oriented within unit 10 relative to the aforementioned referencing surfaces of holder 19. During this orientation, the three support wires 43 were inserted within the respective eyelets 27 which in turn were only loosely positioned within their respective apertures 29. After all of the above precise aligning has occurred, including fixed securement of the clamp and insert members, the lug members 35 were then secured to the respective eyelets using a crimping operation.

With further regard to the invention, it is understood that the side-to-side movement of envelope 33 can also include movement toward and away from the viewer in FIG. 2, or various alternative directions if desired, in place of or even in addition to that depicted by arrow "A".

A significant feature of the instant invention is that not only has precisioned alignment been achieved in a highly expeditious manner but such alignment is achieved without the need for cement or the like. Curing time for this material would add appreciably to the overall assembly of such a unit. In addition, cements of this type typically outgas at elevated temperatures, such gas possibly adversely affecting the finished product (e.g., by affecting the internal reflective surfaces of the headlight's reflector. The lamp unit of the instant invention overcomes both of these deleterious occurrences.

As also shown in FIG. 2, reflector 13 includes a projecting neck portion 67 which extends from the rear portion of the reflector and is located about opening 11 (that is, opening 11 extends through the circumferential neck 67). To assist in retaining holder 19 within opening 11, a removable cap member (not shown) is utilized. This cap is adapted for being positioned within (engaging) a corresponding groove (not shown) located within neck 67 and can include a resilient base segment designed for engaging an external surface of holder 19. Such a base segment is preferably resilient to allow flexure thereof during engagement with the holder to prevent lamp misalignment as a result of said engagement. positioning of holder 19 within reflector 13 is accomplished merely be aligning corresponding slots (not shown) within the external surface of the holder with corresponding male protuberances or the like which are spacedly located about the reflector opening 11. Holder 19, having lamp 30 fixedly and precisely positioned therein in the manner defined above, is thus merely inserted within reflector 13 to the depth indicated in FIG. 2. There is thus no need for rotational-type movement of the holder in order to secure its final position within reflector 13. Thereafter, the aforedescribed cap member, preferably including a large central orifice adapted for passing over the exterior surfaces of the rear portion of holder 19, is simply screwed onto the upstanding neck portion 67 of reflector 13. Retention of this cap is preferably assured by provision of an upstanding flange on holder 19. A similar number of projecting segments (not shown) which form part of the cap are designed for passing through various recesses after which the cap is rotated a short distance to effect locking.

To further assure a sound hermetic seal between the exterior surfaces of holder 19 and the corresponding internal surface of opening 11, a rubber O-ring 82 is provided. As shown in FIG. 2, O-ring 82 is positioned within a corresponding groove or slot within the holder's external surface and projects slightly thereabove. Accordingly, a compression fit is provided between the outermost edge of the O-ring and the corresponding internal surfaces of holder 19.

There has thus been shown and described a replaceable lamp unit for use within an automobile headlight wherein the unit provides both a hermetic seal between the electric lamp used therein and the holder, in addition to an effective means of precisely aligning the lamp in fixed relationship to the holder. As shown in FIG. 2, an automobile headlight capable of using replaceable lamp unit 10 includes the concave reflector 13 and the corresponding front lens member 41 which may be sealed to the reflector in any manner known in the art. It is also within the scope of the invention to utilize a reflector and lens which constitute an integral unit, thus eliminating the need for a seal therebetween. Suitable materials for the reflector and lens are glass and plastic (e.g., polycarbonate). With lamp unit 10 in position within reflector 13, the filament structure of the electric lamp used therein is precisely oriented relative to the reflective surfaces of the reflector, and the focal point and optical axis thereof. Should the lamp fail (burn out), replacement is readily achieved by removing the external connector and retaining cap member, withdrawing the holder and contained lamp, and thereafter directly inserting a new holder-lamp assembly. The retaining cap and external connector are then located in place.

While there have been shown and described what are at present considered the preferred embodiments of the invention, it will be obvious to those skilled in the art that various changes and modifications may be made therein without departing from the scope of the invention as defined by the appended claims.

What is claimed is:

1. In a lamp unit wherein said lamp unit includes an electrically insulative holder for being positioned within said opening and defining a cavity therein and an electriic lamp adapted for being positioned within said holder, said lamp including an envelope having a filament structure therein and a sealed end portion having at least two lead-in wires projecting therefrom, said filament structure being oriented within said reflector of said automobile headlight when said holder is positioned within said opening, the improvement comprising:

a clamp member secured about said sealed end portion of said envelope of said electric lamp at a precise location relative to said filament structure, said sealed end portion of said envelope including means formed therein for aligning said clamp member at said precise location; and an insert member located at a predetermined depth within said cavity of said insulative holder and including an aperture therein, said clamp member being located an established depth within said aperture of said insert member and fixedly secured to said insert member such that said filament structure will be oriented within said reflector in a precise manner relative thereto when said insulative holder is positioned within said reflector opening.

2. The improvement according to claim 1 wherein said end portion of said envelope is a pressed end portion.

3. The improvement according to claim 2 wherein said means formed within said pressed end portion of said envelope for aligning said clamp member includes at least one groove, at least a portion of said clamp member being oriented within said groove.

4. The improvement according to claim 3 wherein the number of grooves within said pressed end portion of said envelope is two, each of said grooves being located within a respective one of two opposing sides of said end portion.

5. The improvement according to claim 3 wherein said clamp member includes a plurality of upstanding flange segments spacedly located thereon and said aperture within said insert member includes a plurality of spaced-apart slot portions, each of said flange segments being located within a respective one of said slot portions.

6. The improvement according to claim 5 wherein the number of said flange segments and the number of said slot portions is four.

7. The improvement according to claim 1 wherein said clamp member is fixedly secured to said insert member by soldering.

8. The improvement according to claim 7 wherein said fixed securement is accomplished using a solder preform positioned on said insert member when said clamp member is located therein, said solder preform thereafter being heated and caused to melt whereupon said solder will flow and interconnect said clamp and insert members.

9. In an automobile headlight including a concave reflector having an opening within the rear portion thereof, a front lens member for directing light from said headlight in a predetermined manner, and a lamp unit for being removably positioned within said opening of said reflector, said lamp unit including an electrically insulative holder for being positioned within said opening and defining a cavity therein and an electric lamp adapted for being positioned within said holder, said lamp including an envelope having a filament structure therein and a sealed end portion having at least two lead-in wires projecting therefrom, said filament structure being oriented within said reflector of said automobile headlight when said holder is positioned within said opening, the improvement comprising:

a clamp member secured about said sealed end portion of said envelope of said electric lamp at a precise location relative to said filament structure, said sealed end portion of said envelope including means formed therein for aligning said clamp member at said precise location; and an insert member located at a predetermined depth within said cavity of said insulative holder and including an aperture therein, said clamp member being located an established depth within said aperture of said insert member and fixedly secured to said clamp member such that said filament structure will be oriented within said reflector in a precise manner relative thereto when said insulative holder is positioned within said reflector opening.

10. The improvement according to claim 9 wherein said end portion of said envelope of said electric lamp is a pressed end portion.

11. The improvement according to claim 10 wherein said means formed within said pressed end portion of said envelope for aligning said clamp member includes at least one groove, at least a portion of said clamp member being oriented within said groove.

12. The improvement according to claim 11 wherein the number of grooves within said pressed end portion of said envelope is two, each of said grooves being located within a respective one of two opposing sides of said end portion.

13. The improvement according to claim 11 wherein said clamp member includes a plurality of upstanding flange segments spacedly located thereon and said aperture within said insert member includes a plurality of spaced-apart slot portions, each of said flange segments being located within a respective one of said slot portions.

14. The improvement according to claim 13 wherein the number of said flange segments and the number of said slot portions is four.

15. The improvement according to claim 9 wherein said clamp member is fixedly secured to said insert member by soldering.

16. The improvement according to claim 15 wherein said fixed securement is accomplished using a solder preform positioned on said insert member when said clamp member is located therein, said solder preform thereafter being heated and caused to melt whereupon said solder will flow and interconnect said clamp and insert members.

* * * * *

UNITED STATES PATENT AND TRADEMARK OFFICE

CERTIFICATE OF CORRECTION

PATENT NO. : 4,623,958

DATED : November 18, 1986

INVENTOR(S) : JOHN R. VAN DER LINDE ET AL

It is certified that error appears in the above-identified patent and that said Letters Patent are hereby corrected as shown below:

Column 8, line 32 - after "unit" and before "includes" insert --for being removably positioned within an opening within the rear portion of an automobile headlight reflector wherein said lamp unit--.

Column 8, line 35 - delete "electriic" and insert --electric--.

Signed and Sealed this

Seventh Day of April, 1987

*Attest:*

DONALD J. QUIGG

*Attesting Officer*

*Commissioner of Patents and Trademarks*